United States Patent [19]

Heiss et al.

[11] 4,307,823

[45] Dec. 29, 1981

[54] POWDER DISPENSER

[75] Inventors: John F. Heiss; William S. Chandler, both of St. Clair, Mich.

[73] Assignee: Diamond Crystal Salt Company, St. Clair, Mich.

[21] Appl. No.: 113,701

[22] Filed: Jan. 21, 1980

[51] Int. Cl.[3] ..... B67D 5/54; B05B 11/04

[52] U.S. Cl. ..... 222/633; 222/211; 239/327

[58] Field of Search ..... 222/209, 211, 631, 632, 222/633; 239/327, 328

[56] References Cited

U.S. PATENT DOCUMENTS

| | | | |
|---|---|---|---|
| 2,151,418 | 3/1939 | Bolte | 222/633 X |
| 2,450,205 | 9/1948 | Rose | 222/632 |
| 3,224,648 | 12/1965 | Zimmermann | 222/633 |
| 3,926,343 | 12/1975 | Kleiner | 222/631 X |
| 4,007,858 | 2/1977 | Shay | 222/633 |

*Primary Examiner*—David A. Scherbel

*Attorney, Agent, or Firm*—Harness, Dickey & Pierce

[57] ABSTRACT

A powder dispenser suitable for use as a first extinguisher and for dispensing particulated solids comprising a container having flexible side walls and formed with an annular neck portion on which a dispensing head is mounted having an orifice terminating in a discharge nozzle. A first conduit is connected at its upper end to the orifice of the dipensing head and extends downwardly within the container such that the lower inlet end thereof is disposed at a position spaced from the base of the container. A second conduit is positioned in encircling relationship around the first conduit in substantially concentric relationship forming an annulus having its upper end disposed in communication with the upper end of the interior of the container and its lower end terminating at a position axially spaced upwardly from the inlet end of the first conduit at a controlled distance corresponding to about one-eighth to about one-half the diameter of the first conduit such that upon deflection of the side walls of the container such as by squeezing, a fluidization of the powder adjacent to the inlet end of the first conduit is effected providing an optimum air to powder ratio which is discharged from the dispensing head in the form of a well defined substantially uniform dispersion.

8 Claims, 5 Drawing Figures

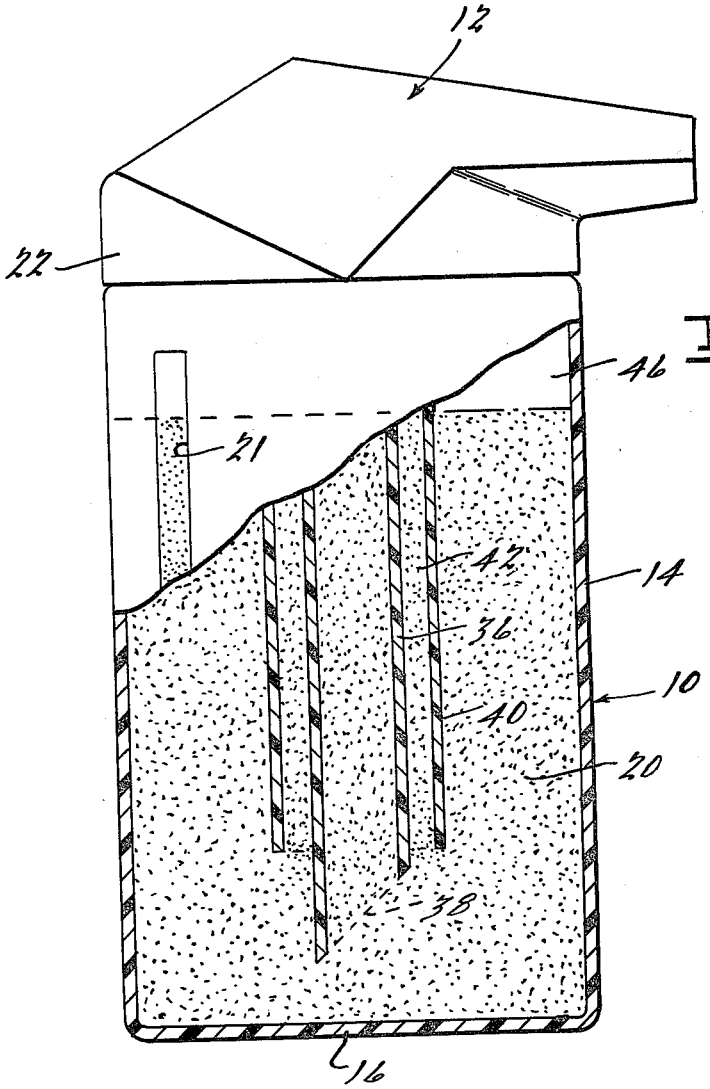
FIG. 1.
FIG. 4.
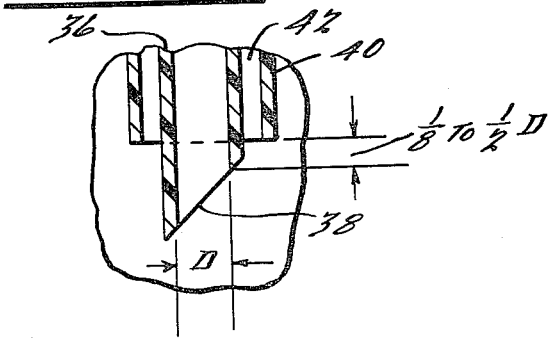
FIG. 5.
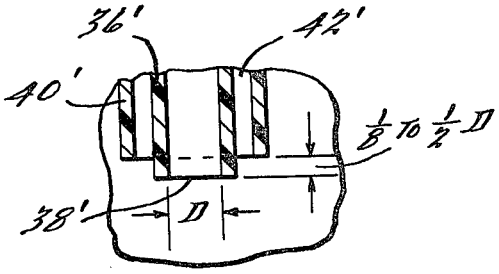

POWDER DISPENSER

BACKGROUND OF THE INVENTION

A variety of powder dispensers have heretofore been used or proposed for use for dispensing fine-sized particulated solid materials of a variety of compositions including insecticides, herbicides, fire extinguishing compositions, talcum powder, deodorants and the like. The powder dispenser of the present invention is particularly applicable, but not necessarily restricted to the dispensing of dry fire extinguishing compositions provided for a portable and effective fire extinguisher particularly adaptable for residential use in extinguishing cooking fires or the like.

Powder dispensers of the so-called squeeze-bottle type to which the present invention is applicable include a container of a flexible material such as plastic to provide side walls that can readily be deflected inwardly by the fingers to effect a manual discharge of the powder contents in a series of intermittent bursts. A continuing problem associated with such squeeze-bottle type powder dispensers has been the inability to attain substantially uniformly dispersed air-powder discharge streams having a well defined discharge pattern which can be directed at objects at considerable range such as about four to five feet. Additionally, powder dispensers of the types heretofore known have not been capable of discharging substantially large amounts of powder during each dispensing action rendering them less effective for extinguishing fires in which large quantities of finely dispersed particles are required to rapidly absorb heat in order to quickly and effectively extinguish fires.

Typical of prior art powder dispensers are those as described in U.S. Pat. Nos. 2,450,205 and 4,007,858. In accordance with the foregoing squeeze-bottle type powder dispensers, porous plug means are employed for preventing entry of the powder into the air conduit or baffle means are employed to improve the fluidization of the powder which impede and substantially reduce the capacity of the dispensers in the quantity of powder dispensed.

Many of the problems and disadvantages associated with prior art powder dispensers are overcome in accordance with the present invention by which an improved powder dispenser is provided which is of simple design, versatile use, which has an increased capacity of powder discharge per discharge action rendering it adaptable for discharging fire extinguishing compositions, achieves improved fluidization of the powder constituents providing for a well defined uniform dispersion of the powder constituents in a well directed projecting discharge stream, which is of a construction enabling replenishment of the powder contents thereof and which is of economical manufacture and use.

SUMMARY OF THE INVENTION

The benefits and advantages of the present invention are achieved by a powder dispenser comprising a container adapted to contain a quantity of a powder to be dispensed and which is formed with a flexible side wall, a base and an annular neck portion adapted to removably receive a dispensing head in closing relationship. A dispensing head is formed with an orifice disposed in communication at its inward end with the interior of the container and terminating in a discharge nozzle at the other end thereof. A first or discharge conduit is connected at its upper end to the orifice of the dispensing head and extends downwardly thereform within the interior of the container and terminates with its inlet end disposed at a position spaced from the base of the container. A second conduit is disposed in encircling relationship around the discharge conduit in substantially concentric relationship forming an annulus having its upper end disposed in communication with the upper end of the container and its lower end terminating at a controlled position axially spaced upwardly from the inlet port in the inlet end of the discharge conduit a distance corresponding to about one-eighth to about one-half the diameter of the discharge conduit.

In accordance with a preferred embodiment of the present invention, the combined volume of the annulus, interior of the discharge conduit and the orifice in the dispensing head is no greater than the volumetric reduction of the interior of the container in response to inward deflection of the side walls to a maximum deflection during squeeze operation of the dispenser whereby all of the powder initially present in the discharge conduit and annulus is discharged or emptied during the first dispensing action.

In accordance with a further preferred embodiment of the present invention, the nozzle in the dispensing head is of a venturi configuration including a convergent upstream section and a divergent downstream section such that the air-powder mixture is accelerated on passing through the constricting portion of the nozzle achieving an improved dispersion of the fine-sized particles and providing a discharge pattern which can be accurately directed at objects disposed at a substantial distance from the dispenser.

Additional benefits and advantages of the present invention will become apparent upon a reading of the description of the preferred embodiments taken in conjunction with the accompanying drawings.

BRIEF DESCRIPTION OF THE DRAWINGS

FIG. 1 is a side elevational view, partly in section, illustrating a powder dispenser constructed in accordance with the preferred embodiments of the present invention;

FIG. 4 is a fragmentary vertical sectional view of the lower portion of the discharge tube and outer tube showing the relationship of axial projection of the discharge tube relative to the outlet of the outer tube; and FIG. 5 is a fragmentary vertical sectional view similar to that of FIG. 4 illustrating the end portion of the discharge tube with an alternative configuration.

DESCRIPTION OF THE PREFERRED EMBODIMENTS

Figure 2:
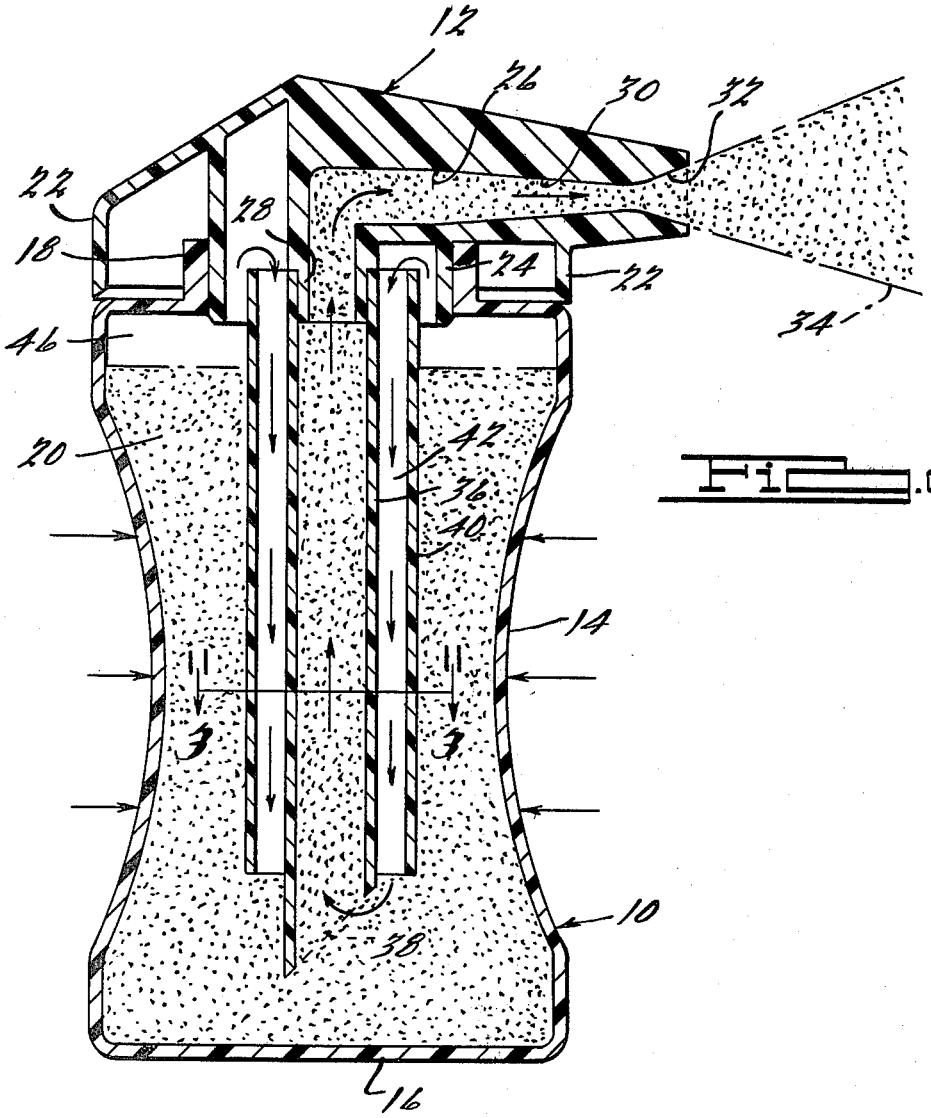
FIG. 2 is a vertical sectional view of the powder dispenser shown in FIG. 1 further illustrating the side walls of the flexible container deflected inwardly as in a dispensing action.

Referring now in detail to the drawings, and as may be best seen in FIGS. 1 and 2, a powder dispenser in accordance with the present invention comprises a three-dimensional flexible container 10 having a dispensing head 12 removably secured to the top portion thereof. The container 10 is of a generally circular cylindrical configuration and includes a cylindrical side wall 14 integrally connected to a circular base 16 at the lower end thereof and terminating in an annular neck portion 18 at the upper end thereof. At least the side wall 14 of the container is of a flexible construction to enable inward deflection of the side wall such as by squeezing from a normal non-deflected condition as shown in FIG. 1 to an inwardly deflected configuration as shown in FIG. 2 to effect a dispensing of the powder material 20 contained therein. Conventionally, the entire container 10 is composed of a suitable plastic material such as polyolefin resins of which polyethylene comprises a preferred material. The side wall is preferably provided with an elongated window 21 if the container is comprised of a material which is not transparent or translucent to enable visual inspection of the level of powder therein. The container can conveniently be molded as an integral structure of the desired size and configuration in accordance with techniques well known in the art.

The dispensing head 12 can also be comprised of a molded structure of a rigid or semi-rigid plastic material and includes an annular depending skirt 22 which is adapted to overlie the upper end portion of the container side wall 14 providing an uninterrupted continuity of the exterior configuration of the dispenser. The dispensing head is also provided with an annular depending collar 24 which is adapted to be slidably engaged in sealing engagement with the inner surface of the neck portion 18 of the container serving as a closure for the air and powder constituents contained therein. The dispensing head further includes a projecting portion formed with an L-shaped orifice 26 extending therethrough with the inner end of the orifice terminating in a shouldered tubular member 28 positioned substantially centrally of the collar 24 and neck portion 18 of the container. The opposite or discharge end of the orifice 26 includes an upstream convergent section 30 and a downstream divergent section 32 as best seen in FIG. 2 defining in combination a venturi-type discharge nozzle from which the air-powder mixture is discharged in the form of a directionally oriented stream indicated at 34 in FIG. 2.

A first conduit or discharge tube 36 as shown in FIG. 2 is affixed at its upper end around the tubular member 28 of the dispensing head and extends downwardly and substantially centrally of the interior of the container with its lower outlet end disposed in a position spaced from the inner surface of the base 16 of the container. The lower end portion of the discharge tube 36 is formed with an inlet port 38 which, in accordance with a preferred practice of the present invention, is achieved by chamfering the end portion of the discharge tube at an angle from a plane perpendicular to the longitudinal axis thereof. Preferably, the angle of chamfer defining the inlet port of the discharge tube is about 45°.

Figure 3:
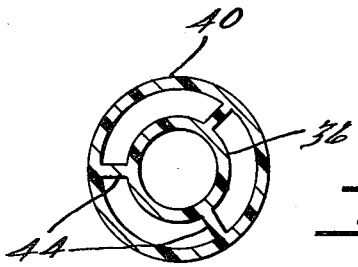
FIG. 3 is a transverse sectional view through the discharge tube and outer tube of the dispenser shown in FIG. 2 and taken along the line 3—3 thereof.

A second conduit or air tube 40 is disposed in spaced encircling substantially concentric relationship around the periphery of the discharge tube 36 defining an annulus 42. The discharge tube 36 and air tube 40 can be integrally molded or extruded of a semi-rigid or rigid plastic material and can include one or a plurality of radially oriented longitudinally extending vanes 44 as best shown in FIG. 3 to maintain the discharge tube and air tube in substantially concentric spaced relationship.

The upper end of the annulus 42 and upper end edge of the air tube 40 terminate at a position in communication with the air space indicated at 46 in FIG. 2 at the upper end of the container above the powder level. The lower end of the air tube 40 and annulus 42 terminates at a position axially spaced upwardly from the uppermost edge of the inlet port 38 of the discharge tube. In accordance with the discovery comprising the present invention, it has been found important that the relationship of the termination of the lower end of the annulus and the inlet port of the discharge tube be carefully controlled within the relationship as schematically illustrated in FIG. 4 to provide an axial spacing of about one-eighth up to about one-half the diameter (D) of the internal diameter of the discharge tube (D) in order to achieve optimum fluidization of the powder in the container achieving the requisite quantity during each dispensing action and avoiding any bypassing of air from the annulus to the discharge tube.

It will be appreciated that the inlet end of the discharge tube can also be of a square configuration as alternatively illustrated in FIG. 5 such that the inlet port 38' of the discharge tube 36' lays in a plane substantially perpendicular to the longitudinal axis of the discharge tube. It is important, as in the case of the relationship illustrated in FIG. 4, that the discharge end of the annulus 42' and lower edge of the air tube 40' be spaced axially upwardly from the inlet port 38' a distance corresponding to about one-eighth to about one-half of the internal diameter (D) of the discharge tube to achieve optimum dispensing action.

In operation, the container is filled with a particulate material to be dispensed to a level below the neck portion 18 to provide for a sufficient air gap to effect fluidization of the powder during the first dispensing action. The dispensing head, after filling, is affixed in sealing and closing relationship in the neck portion preparatory to a dispensing action. The condition of the powder dispenser in the stand-by condition is illustrated in FIG. 1 in which the powder mixture is at a substantially uniform level within the container, annulus and discharge tube.

When the powder dispenser is to be employed as a portable fire extinguisher for extinguishing household cooking fires or flare-ups, a solid particulate fire extinguishing composition of any one of a variety of types can be employed. A fire extinguishing composition which has been found particularly satisfactory for use in the powder dispenser of the present invention comprises a uniform mixture containing about 48% by weight sodium chloride, about 48% by weight sodium bicarbonate, about 2% by weight calcium stearate and about 2% by weight of tricalcium phosphate. The calcium stearate and tricalcium phosphate constituents serve as flow agents and anti-caking agents of the powder mixture. It has been found that particularly satisfactory fire extinguishing results are obtained when the aforementioned fire extinguishing powder is of an average particle size of about 27 microns wherein 85% thereof is less than 325 mesh (44 microns) achieving excellent powder dispersion and presenting high surface area of solids for heat absorption.

In a dispensing action, the powder dispenser is grasped manually and the side walls are deflected inwardly by the fingers from a position as shown in FIG. 1 to the deflected position shown in FIG. 2 whereby the contents of the container are compressed causing air from the air space 46 to move downwardly through the annulus 42 in a direction as indicated by the arrows and out beyond the lower end of the air tube 40 effecting a discharge of air enriched powder from the annulus which travels downwardly beyond the spaced edge of the lower end portion of the discharge tube 36 and upwardly through the port 38 simultaneously carrying the powder within the discharge tube outwardly through the orifice for discharge through the venturi nozzle. Upon releasing the side wall, the container reassumes the non-deflected position as shown in FIG. 1 causing a reduced pressure within the interior of the container whereby air is drawn inwardly of the nozzle and downwardly of the discharge tube and upwardly through the annulus and through the powder mixture therearound replenishing the air in the air space 46. Upon the next dispensing action, the powder within the discharge tube and annulus is in a substantially loose aerated condition and the dispensing action is again repeated by inward deflection of the container causing a second burst of an air-powder dispersion from the venturi discharge nozzle in which the powder content discharged is slightly less than that of the initial burst because of the aerated condition of the powder within the discharge and air conduit. Subsequent dispensing actions have been found to provide substantially equal amounts of powder to be dispensed as is occasioned during the second and subsequent dispensing actions.

When the powder dispenser is employed as a portable fire extinguisher employing a powdered fire extinguishing material as previously described, it has been found that powder quantities of about 50 to about 100 grams per dispensing action are necessary to achieve effective fire extinguishing operation. This can satisfactorily be achieved employing a discharge tube having an inner diameter of about ½ inch, an outer diameter of about ⅝ inch with the inlet port chamfered at a 45° angle in accordance with the embodiments shown in FIGS. 1, 2 and 4 and having a length of about 6 inches. The outer air tube is of a internal diameter of ⅞ inch and an outer diameter of 1 inch and of a length of about 5⅜ inches. The venturi nozzle at the maximum constricted section is of a diameter of about 7/32 inch with the upstream orifice being of an internal diameter of about ½ inch and with the discharge end of the nozzle being about 19/64 inch. The venturi radius defining the convergent and divergent sections may conveniently be about 12 inches.

In accordance with the dispensing operation as previously described, it is apparent that the first dispensing action serves to empty the accumulated stratified powder within the discharge tube and annulus whereafter subsequent dispensing actions discharge aerated powder accumulations within these same areas. Subsequent dispensing actions following the initial dispensing action result in a aerated powder equilibrium condition within the annulus and interior of the discharge tube attaining substantially uniform quantities and fine dispersions of the powder dispensed during such subsequent actions. It is an important feature of the present invention, in order to achieve such uniformity and equilibrium of subsequent dispensing actions that the internal volume of the discharge tube, annulus and orifice including the discharge nozzle be no greater than the volumetric decrease of the container during a maximum inward deflection or squeeze to assure substantially complete unloading of the powder within these sections of the dispenser enabling rapid establishment of equilibrium conditions during further dispensing strokes.

The powder dispenser of the present invention in addition to providing an effective portable fire extinguisher is also eminently adapted for dispensing powdered insecticides and herbicides on flowers and garden plants achieving a substantially uniform coverage of the foliage.

While it will be apparent that the invention herein disclosed is well calculated to achieve the benefits and advantages as hereinabove set forth, it will be appreciated that the invention is susceptible to modification, variation and change without departing from the spirit thereof.

What is claimed is:

1. A powder dispenser comprising a container adapted to contain a quantity of a powder to be dispensed and formed with flexible side walls, a base and an annular neck portion, a dispensing head mounted on said neck portion formed with an orifice terminating in a discharge nozzle, a first conduit connected at its upper end to said orifice of said dispensing head and extending downwardly within said container having an inlet end disposed at a position spaced from said base, said inlet end of said first conduit terminating in an annular edge angularly inclined at an angle relative to a plane perpendicular to the axis of said first conduit, a second conduit encircling said first conduit in substantially concentric relationship forming an annulus having its upper end disposed in communication with the upper end of said container and its lower end terminating at a position axially spaced upwardly from said inlet end of said first conduit a distance corresponding to about one-eighth to about one-half the diameter of said first conduit.

2. The powder dispenser as defined in claim 1 in which the combined volume of said annulus, interior of said first conduit and said orifice is no greater than the volumetric reduction of the interior of said container in response to inward deflection of said side walls to a maximum deflection from diametric opposite sides in which said side walls contact the periphery of said second conduit.

3. The powder dispenser as defined in claim 1 in which said angle is substantially 45° degrees.

4. The powder dispenser as defined in claim 1 in which said discharge nozzle of said dispensing head is formed with a convergent upstream section and a divergent downstream section defining in combination a venturi configuration.

5. The powder dispenser as defined in claim 1 further including at least one radially projecting and longitudinally extending vane interposed in said annulus for maintaining said first and said second conduit in substantially concentric relationship.

6. The powder dispenser as defined in claim 1 in which said dispensing head is formed with an annular collar encircling said orifice and said upper end of said first conduit is secured in overlying relationship around said collar.

7. The powder dispenser as defined in claim 1 further characterized as having a capacity to dispense at least 50 grams of powder during each dispensing action.

8. The powder dispenser as defined in claim 1 further including means in said side wall for visually inspecting the powder level in said container.

* * * * *